US010683727B1

(12) United States Patent
McDaniel et al.

(10) Patent No.: US 10,683,727 B1
(45) Date of Patent: Jun. 16, 2020

(54) VALVE FOR MINERAL EXTRACTION SYSTEMS

(71) Applicant: Cameron International Corporation, Houston, TX (US)

(72) Inventors: Ian McDaniel, Houston, TX (US); Jeffrey Lambert, Tomball, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 0 days.

(21) Appl. No.: 16/219,741

(22) Filed: Dec. 13, 2018

(51) Int. Cl.
*E21B 34/02* (2006.01)
*E21B 43/12* (2006.01)
*E21B 33/06* (2006.01)

(52) U.S. Cl.
CPC ..... *E21B 34/02* (2013.01); *E21B 33/061* (2013.01); *E21B 43/12* (2013.01)

(58) Field of Classification Search
CPC ..... E21B 33/061; E21B 34/02; E21B 43/12
See application file for complete search history.

(56) References Cited

U.S. PATENT DOCUMENTS 1,228,686 A * 6/1917 Maxwell ..... E21B 33/08 166/83.1
1,787,066 A * 12/1930 Carter ..... G08B 9/04 346/33 R
1,938,019 A * 12/1933 Hild ..... E21B 33/06 175/25
2,313,177 A * 3/1943 Sprague ..... E21B 33/061 251/59
2,504,377 A * 4/1950 Beil ..... E21B 33/061 251/1.1
2,685,892 A * 8/1954 Edwards ..... E21B 34/02 137/630.14
3,561,723 A * 2/1971 Cugini ..... E21B 33/064 251/1.2
4,079,860 A * 3/1978 Maves ..... G01F 11/24 222/306
4,537,250 A * 8/1985 Troxell, Jr. ..... E21B 29/08 166/55
4,623,001 A * 11/1986 Vogler ..... F16K 11/0853 137/625.43
5,043,649 A 8/1991 Murakami et al.
5,362,208 A * 11/1994 Inagaki ..... F04B 27/1018 417/222.2
5,431,188 A * 7/1995 Cove ..... E21B 34/02 137/625.3
5,662,171 A * 9/1997 Brugman ..... E21B 33/085 166/383
6,378,841 B1 * 4/2002 Russell ..... F16K 5/201 251/158
6,607,008 B1 * 8/2003 Yoshimoto ..... B06B 1/18 137/624.13

(Continued)

*Primary Examiner* — Matthew R Buck
*Assistant Examiner* — Aaron L Lembo
(74) *Attorney, Agent, or Firm* — Helene Raybaud

(57) ABSTRACT

An assembly for a valve includes an inner cylinder, an outer cylinder circumferentially surrounding the inner cylinder, and a first bar comprising a first end portion coupled to the inner cylinder and a second end portion coupled to the inner cylinder. The second end portion extends radially outwardly through a groove extending circumferentially about a curved wall of the outer cylinder to enable the inner cylinder and the first bar to rotate relative to the outer cylinder.

20 Claims, 12 Drawing Sheets

(56) References Cited

U.S. PATENT DOCUMENTS

| | | | | |
|---|---|---|---|---|
| 7,635,113 | B2 * | 12/2009 | Bearer | F16K 5/0678 251/174 |
| 8,353,497 | B2 * | 1/2013 | Trevas | E21B 33/06 166/387 |
| 9,206,668 | B2 * | 12/2015 | Wood | E21B 29/04 |
| 9,410,391 | B2 * | 8/2016 | Guven | E21B 29/04 |
| 9,845,592 | B2 * | 12/2017 | Wiwi | B08B 9/053 |
| 10,156,116 | B2 * | 12/2018 | Oag | E21B 33/061 |
| 10,167,695 | B2 * | 1/2019 | Kroesen | E21B 33/063 |
| 10,180,190 | B2 * | 1/2019 | G. R. | F15B 13/0406 |
| 2006/0102359 | A1 | 5/2006 | Brown et al. | |
| 2011/0024108 | A1 | 2/2011 | Guidry | |
| 2012/0111573 | A1 | 5/2012 | Bhat | |
| 2016/0281462 | A1 * | 9/2016 | Rytlewski | F16K 31/122 |
| 2017/0204695 | A1 * | 7/2017 | Bodhayan | C09K 8/44 |
| 2018/0238470 | A1 * | 8/2018 | Lah | F16K 5/045 |
| 2018/0347710 | A1 | 12/2018 | Whitby | |
| 2019/0078538 | A1 * | 3/2019 | Hayashi | F16K 1/2265 |
| 2019/0145528 | A1 * | 5/2019 | Lee | F16K 3/34 251/208 |

* cited by examiner

VALVE FOR MINERAL EXTRACTION SYSTEMS

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources, such as oil and gas, are used as fuel to power vehicles, heat homes, and generate electricity, in addition to a myriad of other uses. Once a desired resource is discovered below the surface of the earth, mineral extraction systems are often employed to access and extract the resource. These systems may be located onshore or offshore depending on the location of a desired resource. Such systems generally include a wellhead assembly through which the resource is extracted. At various times, intervention operations may be carried out to inspect or to service the well, for example. During these intervention operations, pressure control equipment is mounted above the wellhead to protect other surface equipment from surges in pressure within the wellbore or to carry out other supportive functions.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present embodiments generally relate to a valve for mineral extraction systems. For example, the valve may be used in a pressure control equipment (PCE) stack. PCE stacks are coupled to and/or positioned vertically above a wellhead during various intervention operations (e.g., inspection or service operations), such as wireline operations in which a tool supported on a wireline is lowered through the PCE stack to enable inspection and/or maintenance of a well. The valve may seal about the wireline or other conduit extending through the PCE stack. Thus, the valve may isolate the environment, as well as other surface equipment, from pressurized fluid within the well.

In the present disclosure, a conduit may be any of a variety of tubular or cylindrical structures, such as a wireline, Streamline™, slickline, coiled tubing, or other spoolable rod. Furthermore, while the disclosed embodiments illustrate and describe a valve for use as part of a PCE stack that is used during intervention operations (e.g., inspection or service operations) to facilitate discussion, it should be understood that the valve may be adapted for use in other contexts and during other operations. For example, the conduit may be a drill string, and the valve may be utilized during drilling operations to seal about the drill string.

Figure 1:
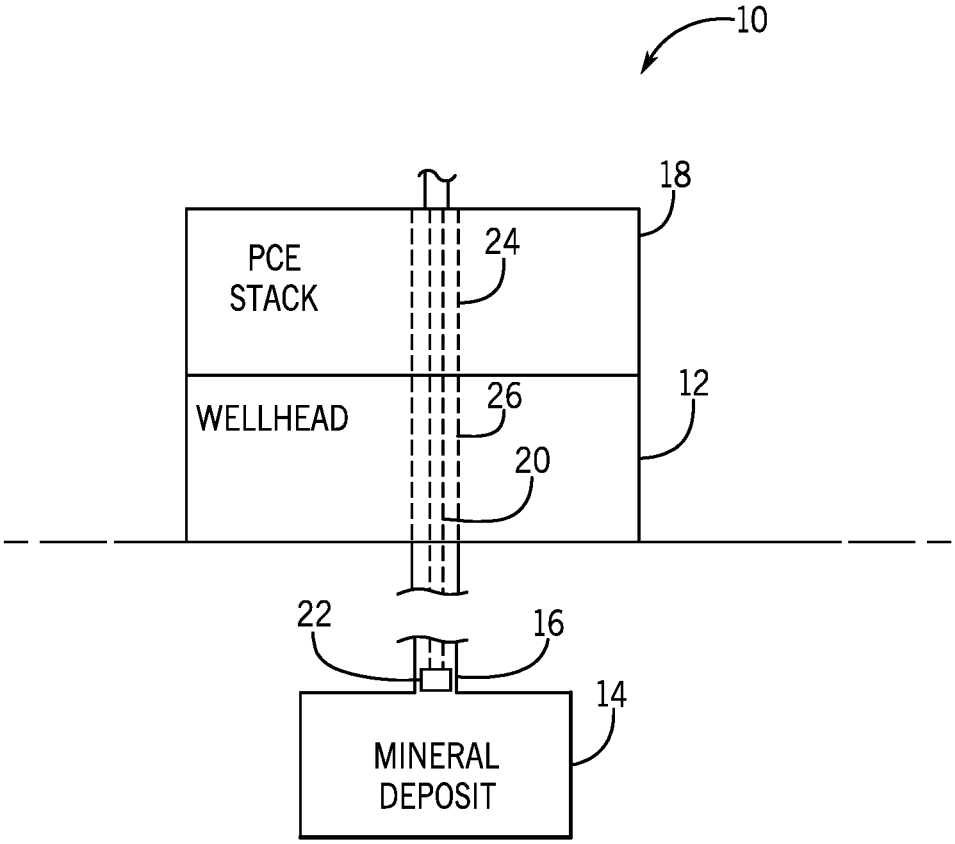
FIG. 1 is a schematic diagram of a system having a pressure control equipment (PCE) stack, in accordance with an embodiment of the present disclosure.

With the foregoing in mind, FIG. 1 is a schematic diagram of an embodiment of a system 10. The system 10 includes a wellhead 12, which is coupled to a mineral deposit 14 via a wellbore 16. The wellhead 12 may include any of a variety of other components such as a spool, a hanger, and a "Christmas" tree. In the illustrated embodiment, a pressure control equipment (PCE) stack 18 is coupled to the wellhead 12 to facilitate intervention operations, which may be carried out by lowering a conduit 20 (e.g., communication conduit, wireline, slickline, spoolable rod, or coiled tubing) and/or a tool 22 (e.g., configured to collect data about the mineral deposit 14 and/or the wellbore 16) through a bore 24 defined by the PCE stack 18, through a bore 26 defined by the wellhead 12, and into the wellbore 16. As discussed in more detail below, the PCE stack 18 may include a valve that seals about the conduit 20 to isolate the environment, as well as other surface equipment, from pressurized fluid within the wellbore 16.

Figure 2:
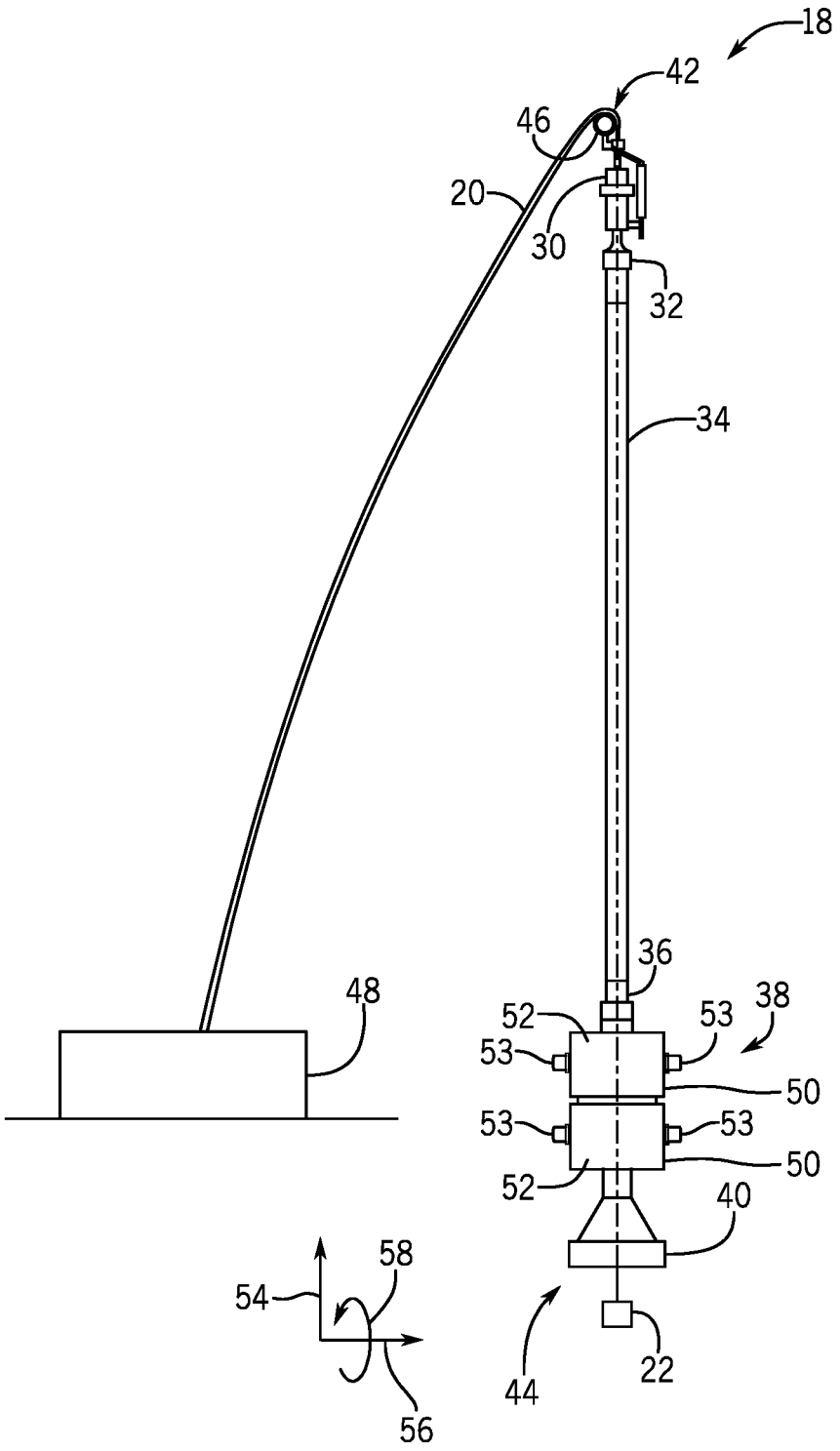
FIG. 2 is a side view of the PCE stack of FIG. 1 having a valve, in accordance with an embodiment of the present disclosure.

FIG. 2 is a side view of an embodiment of the PCE stack 18 that may be used in the system 10 of FIG. 1. The PCE stack 18 may include one or more components that enable the PCE stack 18 to seal about the conduit 20. Thus, the PCE stack 18 may isolate the environment, as well as other surface equipment, from pressurized fluid within the wellbore 16 (FIG. 1).

In the illustrated embodiment, the PCE stack 18 includes a stuffing box 30, a tool catcher 32, a lubricator section 34, a tool trap 36, a valve stack 38, and a connector 40 to couple the PCE stack 18 to the wellhead 12 (FIG. 1) or other structure. These components are annular structures stacked vertically with respect to one another (e.g., coaxial) to enable the conduit 20 to extend through the PCE stack 18 (e.g., from a first end 42 to a second end 44 of the PCE stack 18) into the wellhead 12. As shown, the conduit 20 extends from the first end 42 of the PCE stack 18 and over a sheave 46 to a winch 48, and rotation of the winch 48 (e.g., a drum or spool of the winch 48) raises and lowers the conduit 20 with the tool 22 through the PCE stack 18.

It should be appreciated that the PCE stack 18 may include various other components (e.g., cable tractoring wheels to pull the conduit 20 through the stuffing box 30, a pump-in sub to enable fluid injection). Furthermore, it should be appreciated that the PCE stack 18 may include the valve stack 38 mounted to the wellhead via the connector 40, but the PCE stack 18 may not include one or more of the stuffing box 30, tool catcher 32, lubricator section 34, or tool trap 36. Indeed, the PCE stack 18 may include the valve stack 38 alone or in combination with any of a variety of other components.

In the illustrated PCE stack 18, the stuffing box 30 is configured to seal against the conduit 20 (e.g., to seal an annular space about the conduit 20) to block a flow of fluid from the bore 24 (FIG. 1) vertically above the stuffing box 30. The tool catcher 32 is configured to engage or catch the tool 22 to block the tool 22 from being withdrawn vertically above the tool catcher 32 and/or to block the tool 22 from falling vertically into the wellbore 16. The lubricator section 34 may include one or more annular pipes joined to one another, and the lubricator section 34 may support or surround the tool 22 while it is withdrawn from the wellbore 16. The tool trap 36 is configured to block the tool 22 from falling vertically into the wellbore 16 while the tool trap 36 is in a closed position.

As shown, the valve stack 38 may include one or more valves 50 that are configured to seal the bore 24. In the illustrated embodiment, the valve stack 38 includes two valves 50 that are vertically stacked relative to one another, and each valve 50 includes a housing 52. However, the valve stack 38 may include any suitable number of valves 50 (e.g., 1, 2, 3, 4, or more), and two or more valves 50 may share one housing 52. As discussed in more detail below, at least one of the one or more valves 50 may include rams mounted on concentric cylinders within the housing 52. In operation, the cylinders rotate relative to one another to move the rams between an open position in which the rams do not seal the bore 24 and a closed position in which the rams seal the bore 24 (e.g., seal about the conduit 20 to seal the bore 24).

The various components of the PCE stack 18 may be adjusted via actuators 53 (e.g., electric, hydraulic, pneumatic actuators). For example, in some embodiments, the one or more valves 50 may be adjusted between the open position and the closed position via electric actuators that drive rotation of the cylinders. To facilitate discussion, the valve stack 38 and its components may be described with reference to a vertical axis or direction 54, an axial axis or direction 56, and a circumferential axis or direction 58.

Figure 3:
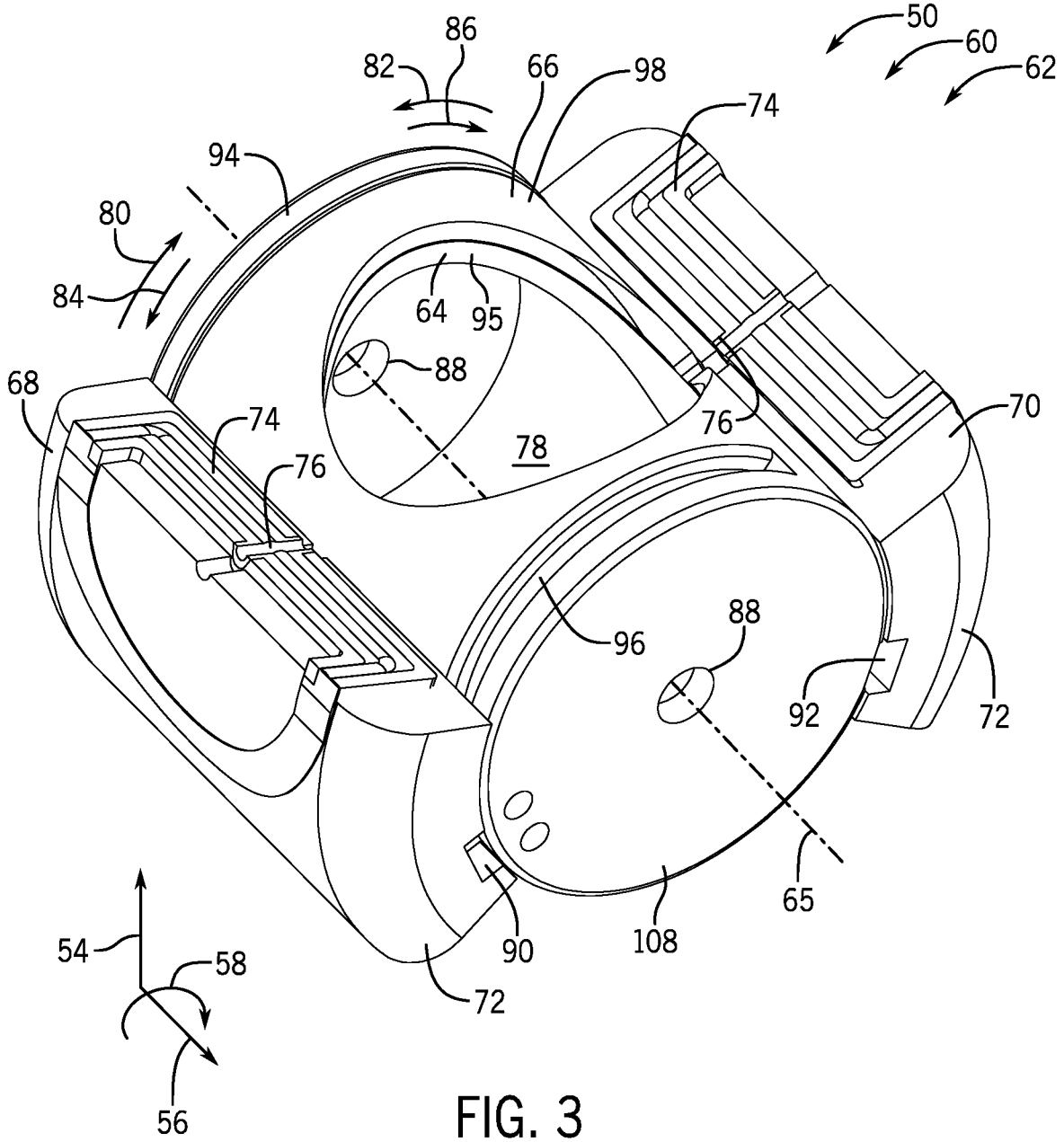
FIG. 3 is a front perspective view of an assembly that may be part of the valve of FIG. 2 in an open position, in accordance with an embodiment of the present disclosure.

FIG. 3 is a front perspective view of a portion of the valve 50 of FIG. 2 in an open position 60, in accordance with an embodiment of the present disclosure. In particular, FIG. 3 illustrates an assembly 62 (e.g., a ram-cylinder assembly) that may be positioned within the housing 52 of the valve 50 of FIG. 2. The assembly 62 includes an inner cylinder 64, an outer cylinder 66, a first ram 68 that moves with the inner cylinder 64, and a second ram 70 that moves with the outer cylinder 66.

The inner cylinder 64 and the outer cylinder 66 are coaxial and share a central axis 65 (e.g., rotational axis) that is parallel to the axial axis 56. Furthermore, the outer cylinder 66 circumferentially surrounds the inner cylinder 64. In the illustrated embodiment, each of the first ram 68 and the second ram 70 include a respective ram body 72, a respective packer 74 (e.g., elastomer packer), and a respective recess 76 that is configured to receive the conduit 20 while the valve 50 is in the closed position. The assembly 62 provides a bore 78 (e.g., vertical bore) to enable the conduit 20 to extend vertically through the assembly 62, and the bore 78 may form part of the bore 24 of the PCE stack 18 shown in FIG. 1.

To move from the open position 60 to the closed position, the inner cylinder 64 and the first ram 68 may move as shown by arrow 80, and the outer cylinder 66 and the second ram 70 may move as shown by arrow 82. Similarly, to move from closed position to the open position 60, the inner cylinder 64 and the first ram 68 may move as shown by arrow 84, and the outer cylinder 66 and the second ram 70 may move as shown by arrow 86. The first ram 68 and the second ram 70 may move toward and away from one another along the circumferential axis 58. The inner cylinder 64 and the outer cylinder 66 may be coupled to one or more actuators (e.g., actuators 53 shown in FIG. 2) that drive the movement (e.g., rotation) of the cylinders 64, 66 and the rams 68, 70. For example, connecting rods may couple to respective openings 88 formed in the cylinders 64, 66 to enable the one or more actuators to drive the movement of the cylinders 64, 66 and the rams 68, 70.

As discussed in more detail below, a first bar may be coupled to the inner cylinder 64 to facilitate coupling the first ram 68 to the inner cylinder 64 and to enable the inner cylinder 64 to drive movement of the first ram 68. Similarly, a second bar may be coupled to the outer cylinder 66 to facilitate coupling the second ram 70 to the outer cylinder 66 and to enable the outer cylinder 66 to drive movement of the second ram 70. As shown, the first ram 68 includes a recess 90 (e.g., axially-extending recess) that is configured to receive the first bar, and the second ram 70 includes a recess 92 (e.g., axially-extending recess) that is configured to receive the second bar.

Furthermore, the inner cylinder 64 includes a lip portion 94 (e.g., radially-expanded portion or edge) that couples to a first end portion of the first bar, and the outer cylinder 66 includes a groove 96 (e.g., circumferentially-extending groove) to enable a second end portion of the first bar to extend through the outer cylinder 66. Thus, the first bar may transfer forces from the inner cylinder 64 to the first ram 68 along a length (e.g., approximately equal to or greater than 75, 80, 85, 90, or 95 percent of an entire axial length) of the first ram 68, even though the inner cylinder 64 is circumferentially surrounded by the outer cylinder 66, even though an end wall 108 of the outer cylinder 66 covers one end of the inner cylinder 64, and even though the outer cylinder 66 is positioned between the inner cylinder 64 and the first ram 68. For example, the first ram 68 does not directly contact a wall 95 (e.g., curved, annular wall) that defines the inner cylinder 64, but instead contacts and/or is positioned adjacent to a wall 98 (e.g., curved, annular wall) that defines the outer cylinder 66. However, the first ram 68 may contact the lip portion 94 of the inner cylinder 64, as shown. Various other features and advantages of the assembly 62 may be understood with reference to the following figures.

Figure 4:
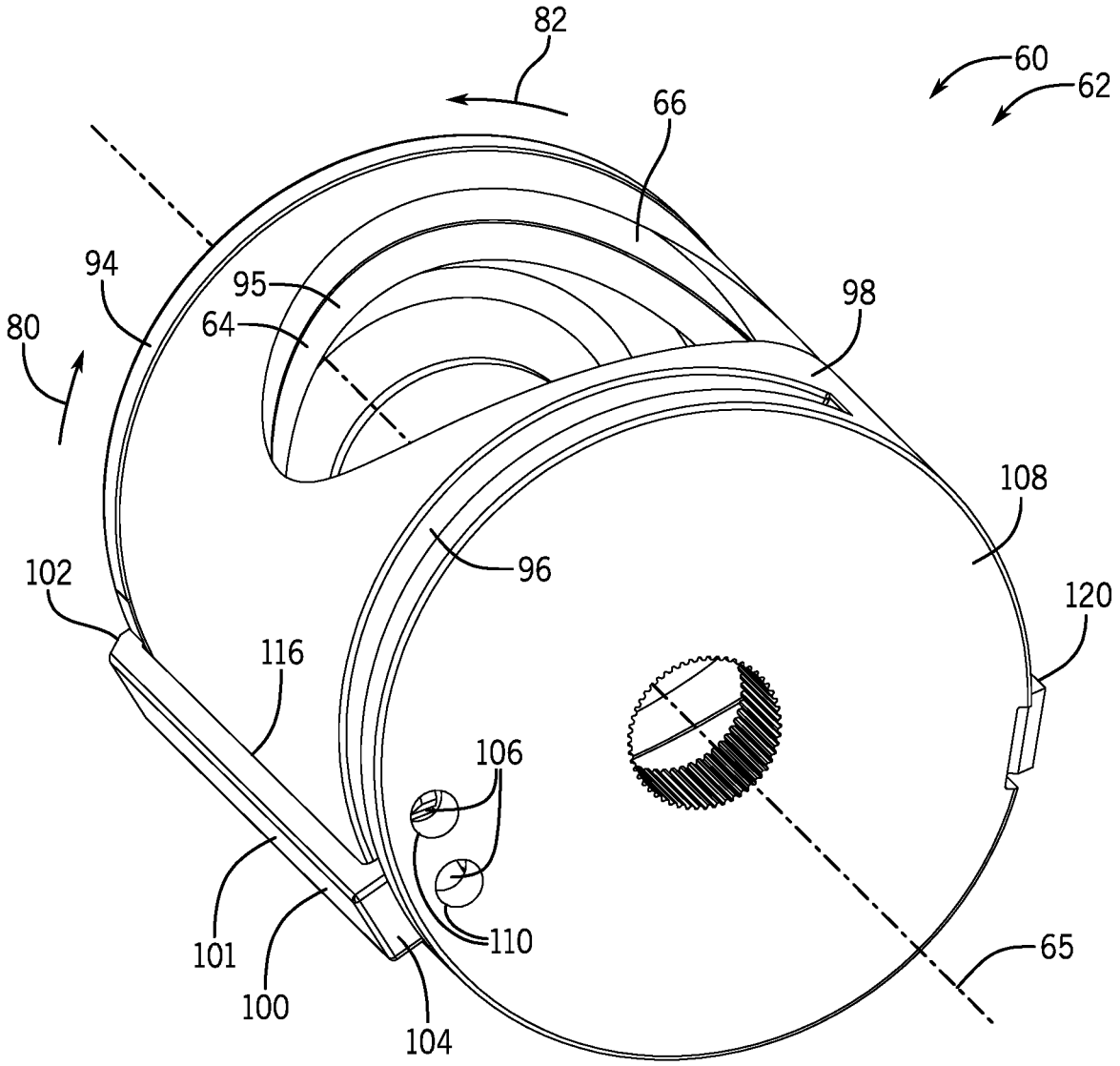
FIG. 4 is a front perspective view of a portion of the assembly of FIG. 2 in the open position, in accordance with an embodiment of the present disclosure.
Figure 4:
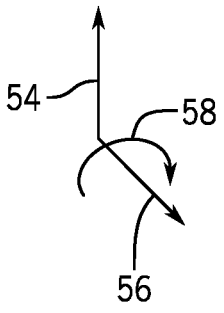

FIG. 4 is a front perspective view of a portion of the assembly 62 of FIG. 3 in the open position 60, in accordance with an embodiment of the present disclosure. In particular, FIG. 4 illustrates the inner cylinder 64 and the outer cylinder 66 that may be part of the assembly 62 of FIG. 3. The inner cylinder 64 and the outer cylinder 66 are coaxial and share the central axis 65 (e.g., rotational axis). Furthermore, the outer cylinder 66 circumferentially surrounds the inner cylinder 64.

A first bar 100 (e.g., inner-cylinder bar or rod) may be coupled to the inner cylinder 64. In the illustrated embodiment, the first bar 100 includes an axially-extending portion 101 (e.g., ram-contacting portion) that extends along the axial axis 56 from a first end portion 102 to a second end portion 104. The first end portion 102 may be a radially-extending portion that is coupled to the lip portion 94 of the inner cylinder 64 via one or more fasteners (e.g., threaded fasteners, such as bolts), and the second end portion 104 may be a radially-extending portion that is coupled to an edge of the inner cylinder 64 via one or more fasteners 106 (e.g., threaded fasteners, such as bolts). In FIG. 4, the edge of the inner cylinder 64 is covered by the end wall 108 of the outer cylinder 66; however, openings 110 in the end wall 108 of the outer cylinder 66 may receive and/or enable access to the one or more fasteners 106 that couple the second end portion 104 of the first bar 100 to the edge of the inner cylinder 64.

Furthermore, as shown, the wall 98 that defines the outer cylinder 66 is positioned between the wall 95 that defines the inner cylinder 64 and a surface 116 (e.g., radially-inner surface) of the axially-extending portion 101 of the first bar 100. Thus, a gap is formed between an outer surface (e.g., curved, annular surface) of the wall 95 that defines the inner cylinder 64 and the surface 116 of the axially-extending portion 101 of the first bar 100, and the gap receives a portion of the wall 98 of the outer cylinder 66. This configuration enables the outer cylinder 66 to surround the inner cylinder 64, and also enables the first bar 100 to be coupled to the inner cylinder 64 and to engage the first ram 68.

In operation, the inner cylinder 64 and the first bar 100 coupled thereto may be driven in the direction of the arrow 80 toward the closed position (e.g., via the actuator 53 of FIG. 2). The first bar 100 may be positioned within and may engage the recess 90 of the first ram 68 (FIG. 3), such that movement of the inner cylinder 64 drives movement of the first ram 68. To enable this movement, the outer cylinder 66 includes the groove 96, and the second end portion 104 of the first bar 100 is positioned within the groove 96. The groove 96 extends radially through the wall 98 that defines the outer cylinder 66, and the groove 96 extends about a portion of the circumference of the wall 98 (e.g., greater than or approximately 25, 35, 45, 55, 65, or 75 percent, or between about 25 to 75, 35 to 65, or 45 to 55 percent of the circumference of the wall 98). When the inner cylinder 64 is driven to move in the direction of the arrow 80, the first bar 100 (e.g., the second end portion 104 of the first bar 100) may move within the groove 96.

A second bar 120 (e.g., outer-cylinder bar or rod) may be coupled to the outer cylinder 66. As discussed in more detail below, the second bar 120 may be coupled to the outer cylinder 66 via one or more fasteners (e.g., threaded fasteners, such as bolts), and the second bar 120 may include an axially-extending portion (e.g., ram-contacting portion) that extends along the axial axis 56 from a first end portion to a second end portion. In operation, the outer cylinder 66 and the second bar 120 coupled thereto may be driven in the direction of the arrow 82 toward the closed position (e.g., via the actuator 53 shown in FIG. 2). The second bar 120 may be positioned within and may engage the recess 92 of the second ram 70 (FIG. 3), such that movement of the outer cylinder 66 drives movement of the second ram 70.

Figure 5:
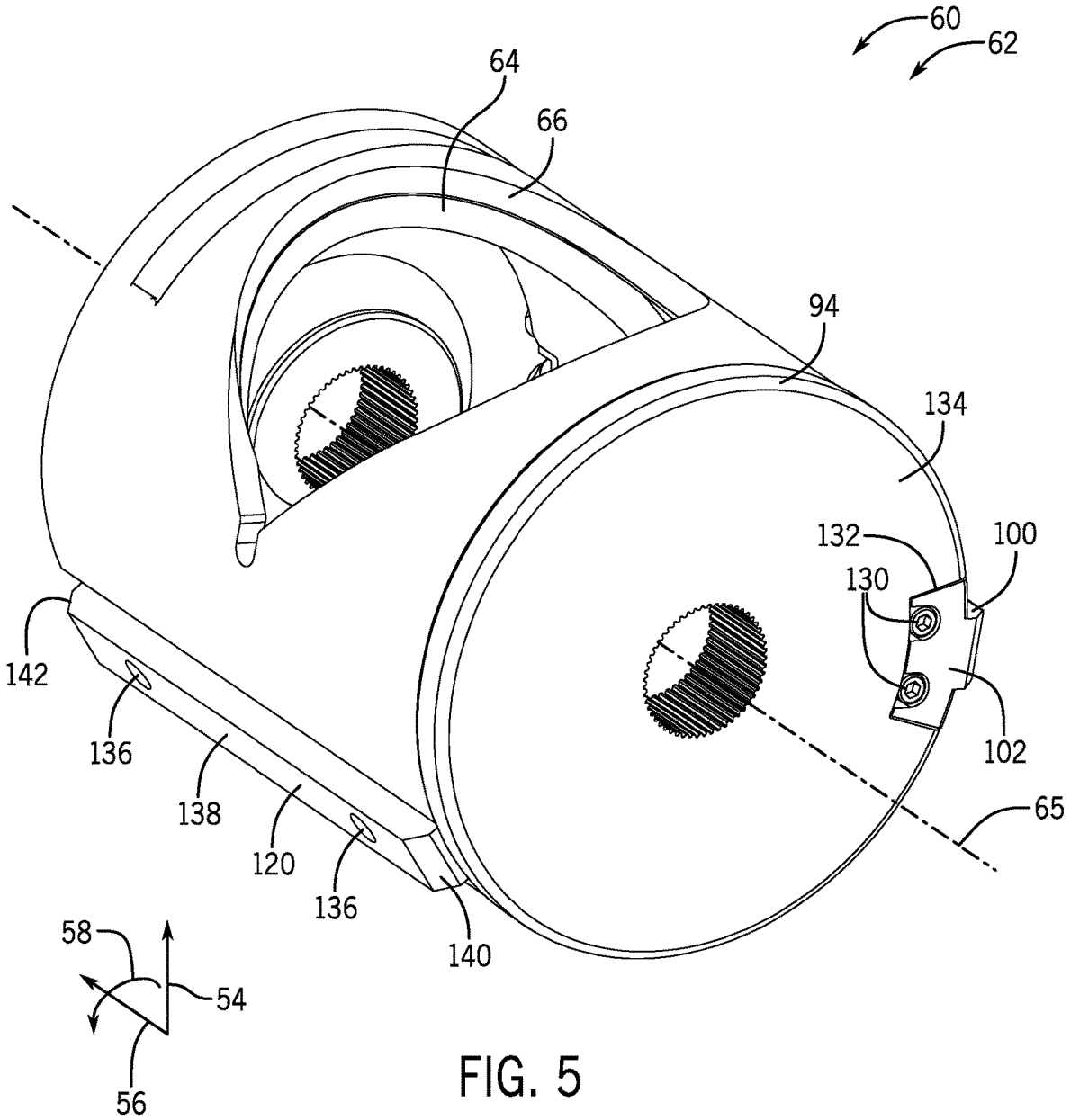
FIG. 5 is a rear perspective view of the portion of the assembly of FIG. 4 in the open position, in accordance with an embodiment of the present disclosure.

FIG. 5 is a rear perspective view of the portion of the assembly 62 of FIG. 4 in the open position 60, in accordance with an embodiment of the present disclosure. In particular, FIG. 5 illustrates the inner cylinder 64 and the outer cylinder 66 that are concentric about the central axis 65. The first bar 100 is coupled to the inner cylinder 64, and the second bar 120 is coupled to the outer cylinder 66.

As shown, the first end portion 102 of the first bar 100 is coupled to the lip portion 94 of the inner cylinder 64 via one or more fasteners 130 (e.g., threaded fasteners, such as bolts). The first end portion 102 of the first bar 100 may be positioned within a recess 132 formed in an end wall 134 of the inner cylinder 64, such that the first end portion 102 is flush (e.g., substantially flush, does not protrude axially) with the end wall 134 of the inner cylinder 64. Additionally, the second bar 120 is coupled to the outer cylinder 66 via one or more fasteners 136 (e.g., threaded fasteners, such as bolts). As shown, the second bar 120 includes an axially-extending portion 138 (e.g., ram-contacting portion) that extends along the axial axis 56 from a first end portion 140 to a second end portion 142.

Figure 6:
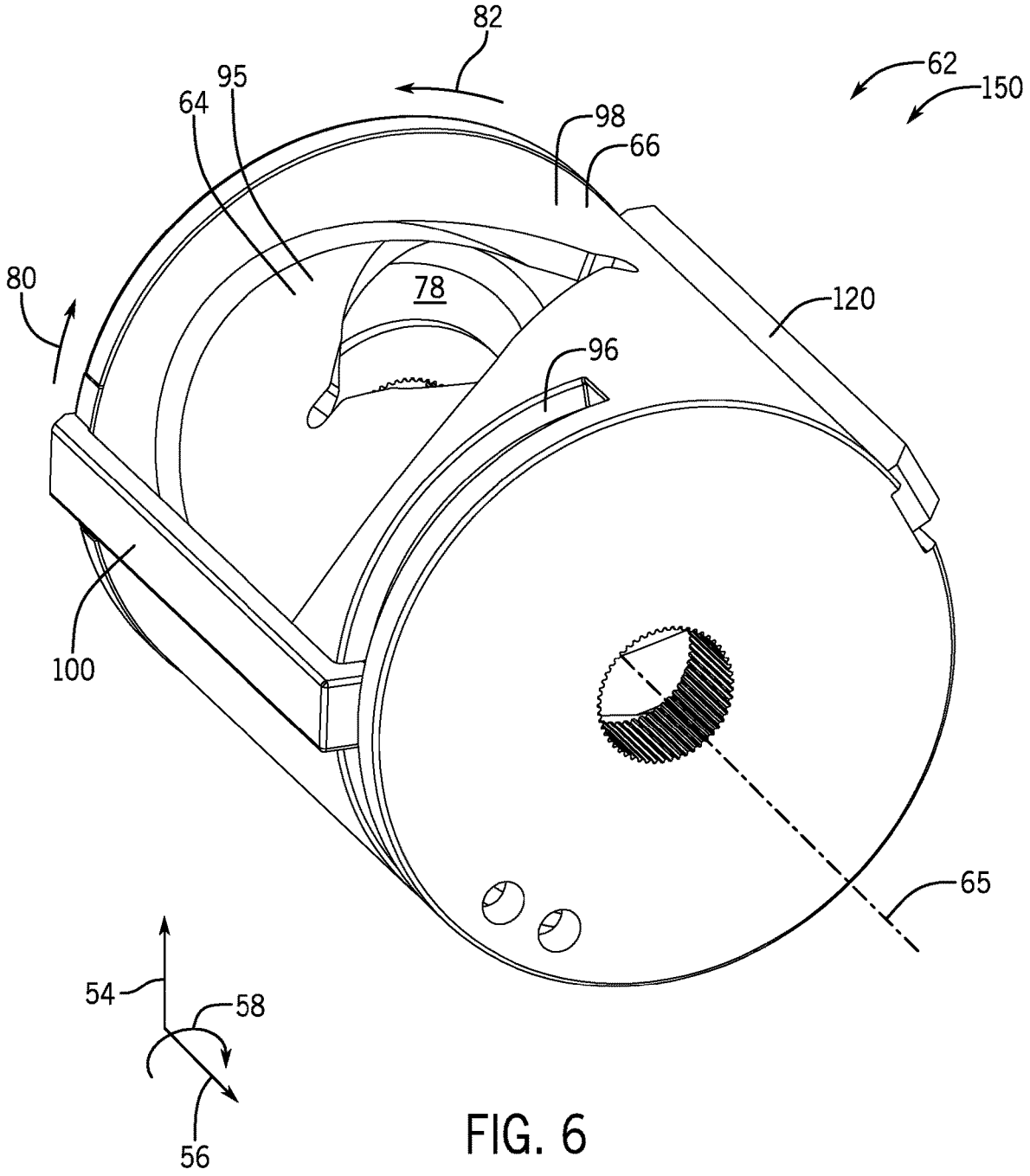
FIG. 6 is a front perspective view of the portion of the assembly of FIG. 4 in an intermediate position, in accordance with an embodiment of the present disclosure.

FIG. 6 is a front perspective view of the portion of the assembly 62 of FIG. 4 in an intermediate position 150, in accordance with an embodiment of the present disclosure. In particular, FIG. 6 illustrates the inner cylinder 64 and the outer cylinder 66 that are concentric about the central axis 65. The first bar 100 is coupled to the inner cylinder 64, and the second bar 120 is coupled to the outer cylinder 66. To reach the intermediate position 150 from the open position 60 shown in FIGS. 3-5, the inner cylinder 64 and the first bar 100 rotate in the direction of arrow 80, and the outer cylinder 66 and the second bar 120 rotate in the direction of arrow 82.

As shown, in the intermediate position 150, the bore 78 is smaller than in the open position 60 because the wall 95 of the inner cylinder 64 and the wall 98 of the outer cylinder 66 move across the bore 78. In the intermediate position 150, the first bar 100 and the second bar 120 (as well as the first ram 68 and the second ram 70, shown in FIG. 3) are closer to one another. To enable the rotation of the inner cylinder 64 and the first bar 100 relative to the outer cylinder 66 and the second bar 120, the outer cylinder 66 includes the groove 96.

Figure 7:
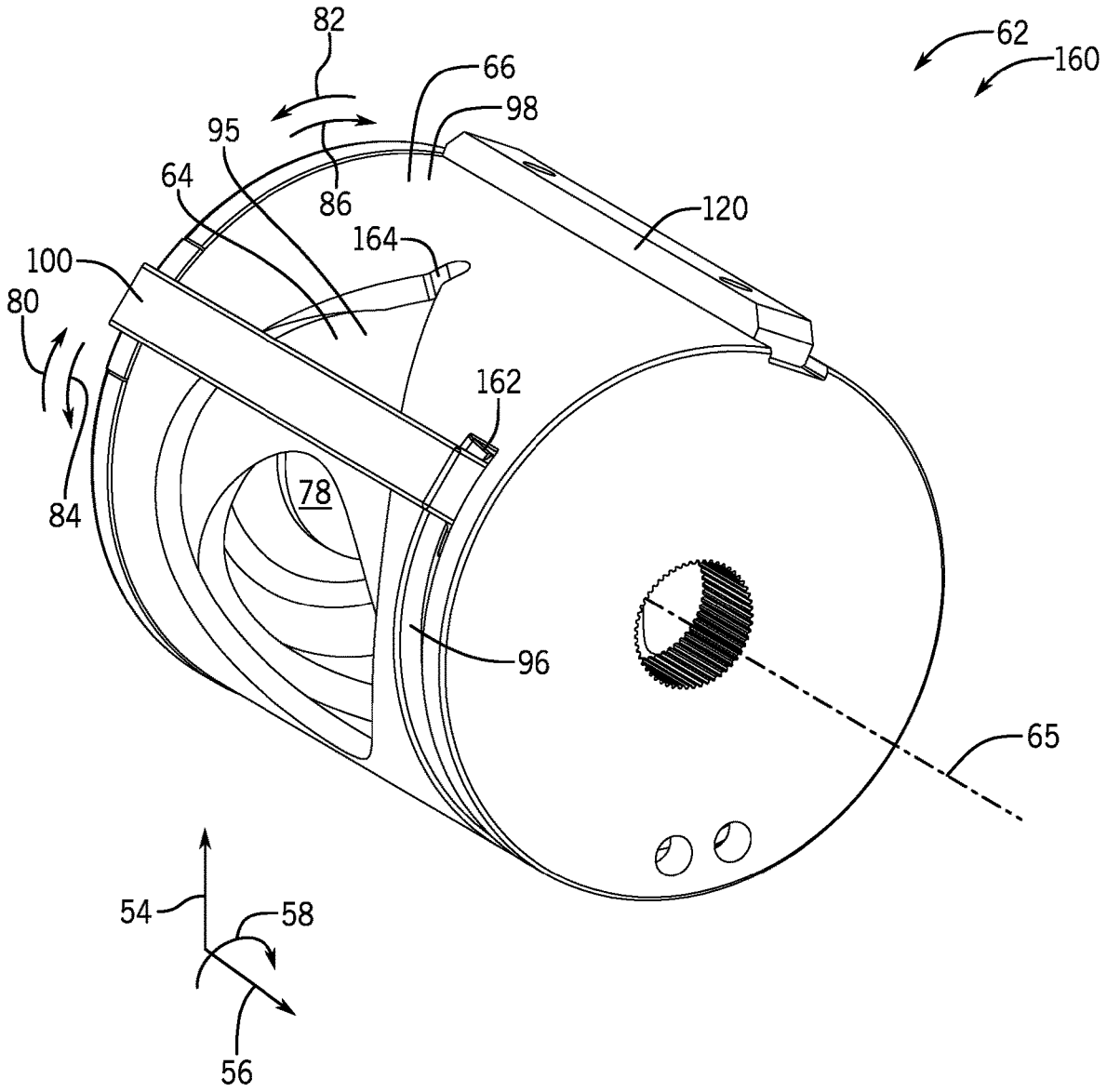
FIG. 7 is a front perspective view of the portion of the assembly of FIG. 4 in a closed position, in accordance with an embodiment of the present disclosure.

FIG. 7 is a front perspective view of the portion of the assembly 62 of FIG. 4 in a closed position 160, in accordance with an embodiment of the present disclosure. In particular, FIG. 7 illustrates the inner cylinder 64 and the outer cylinder 66 that are concentric about the central axis 65. The first bar 100 is coupled to the inner cylinder 64, and the second bar 120 is coupled to the outer cylinder 66. To reach the closed position 160 from the open position 60 shown in FIGS. 3-5 and from the intermediation position 150 shown in FIG. 6, the inner cylinder 64 and the first bar 100 rotate in the direction of arrow 80, and the outer cylinder 66 and the second bar 120 rotate in the direction of arrow 82. In the closed position 160, the second end portion 104 of the first bar 100 may approach or reach an end 162 (e.g., stop or shoulder) of the groove 96. Limiting the size of the groove 96 in this way enables movement between the open position 60 and the closed position 160, while also maintaining the strength and integrity of the outer cylinder 66.

As shown, in the closed position 160, the bore 78 is smaller than in the open position 60 and the intermediate position 150 because the wall 95 of the inner cylinder 64 and the wall 98 of the outer cylinder 66 move across the bore 78. In the illustrated embodiment, the wall 95 of the inner cylinder 64 includes a conduit groove and the wall 98 of the outer cylinder 66 includes a conduit groove 164 to receive and to enable the conduit 20 to extend across the assembly 62 while the valve 50 is in the closed position 160. Furthermore, in the closed position 160, the first ram 68 and the second ram 70 (FIG. 3) contact and seal against one another to block flow of pressurized fluid across the valve 50 (FIG. 2). As noted above, to move from closed position 160 to the open position 60 of FIGS. 3-5, the inner cylinder 64 and the first ram 68 may move as shown by arrow 84, and the outer cylinder 66 and the second ram 70 may move as shown by arrow 86.

Figure 8:
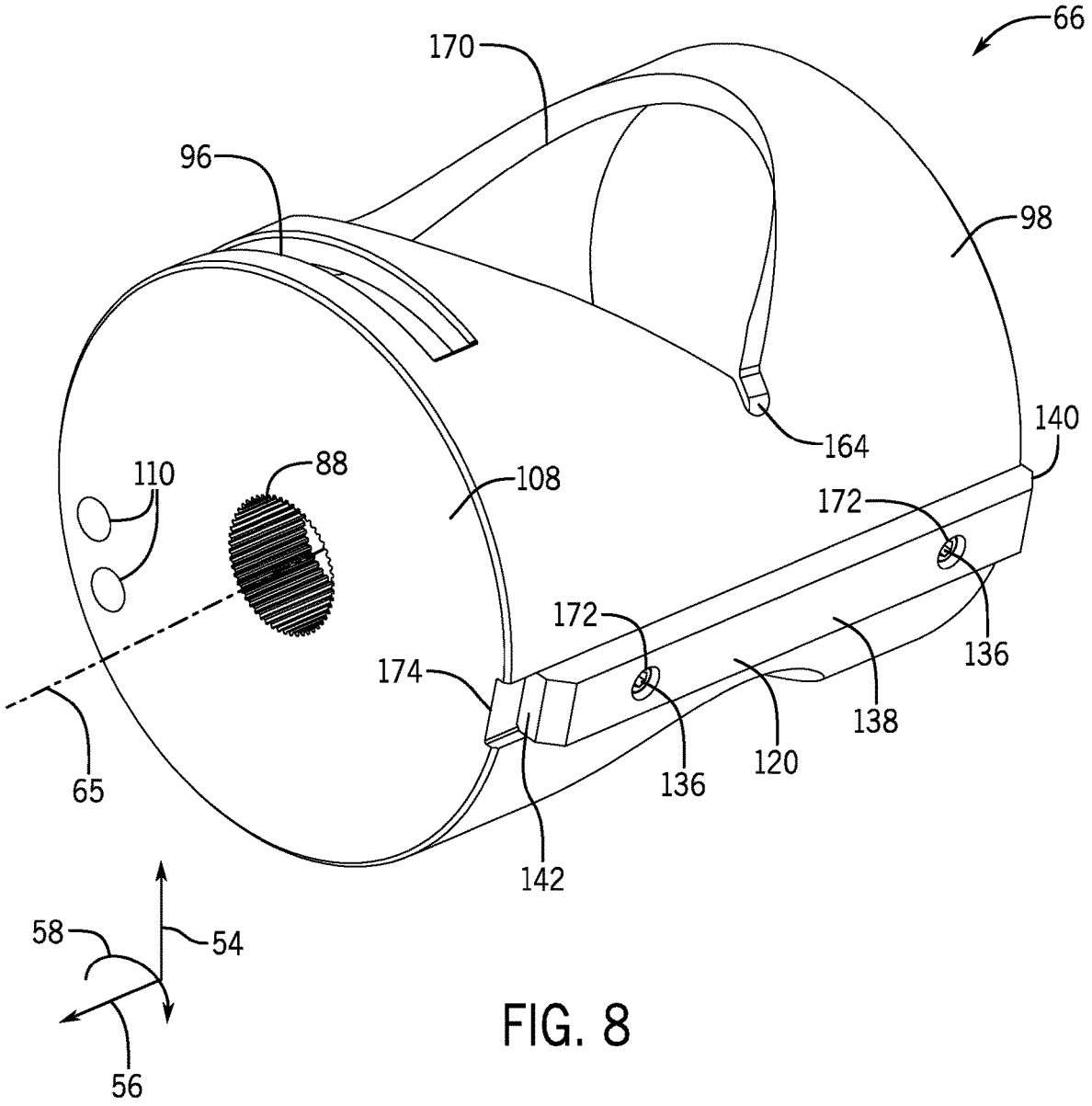
FIG. 8 is a front perspective view of an outer cylinder of the portion of the assembly of FIG. 4, in accordance with an embodiment of the present disclosure.

FIG. 8 is a front perspective view of the outer cylinder 66 and the second bar 120, in accordance with an embodiment of the present disclosure. As discussed above, the outer cylinder 66 may rotate about the central axis 65 via one or more actuators (e.g., actuators 53 shown in FIG. 2). A connecting rod may couple to the opening 88 formed in the end wall 108 to enable the one or more actuators to drive the movement of the outer cylinder 66. As shown, the outer cylinder 66 may also include the wall 98 that includes the groove 96, as well as openings (e.g., an opening 170 and another opening diametrically opposed to the opening 170) that partially define the bore 78 of the assembly 62 (FIG. 3). In the illustrated embodiment, the outer cylinder 66 also includes the conduit groove 164 on an edge of the opening 170. It should be appreciated that a similar conduit groove may be provided on a respective edge of the opening that is diametrically opposed to the opening 170.

In the illustrated embodiment, the second bar 120 is coupled to the outer cylinder 66 via the one or more fasteners 136. While FIG. 8 shows two fasteners 136 that extend through openings 172 formed in the second bar 120, it should be appreciated that any suitable number (e.g., 1, 2, 3, 4, or more) fasteners 136 in any of a variety of locations may be utilized to the couple the second bar 120 to the outer cylinder 66. Furthermore, the second bar 120 may be coupled to the outer cylinder 66 via other techniques (e.g., welding) or the second bar 120 and the outer cylinder 66 may be integrally formed (e.g., one-piece, which may be accomplished via various manufacturing methods, such as additive manufacturing methods).

As shown, the second bar 120 may be positioned within a recess 174 (e.g., axially-extending recess) formed in the wall 98 of the outer cylinder 66. Furthermore, the second bar 120 may extend across a length (e.g., approximately equal to or greater than 75, 80, 85, 90, or 95 percent of an entire axial length) of the outer cylinder 66 and/or the second ram 70. Such a configuration may enable the second bar 120 to exert a force along a length (e.g., approximately equal to or greater than 75, 80, 85, 90, or 95 percent of an entire axial length) of the second ram 70, thereby providing a reliable seal across the valve 50.

Figure 9:
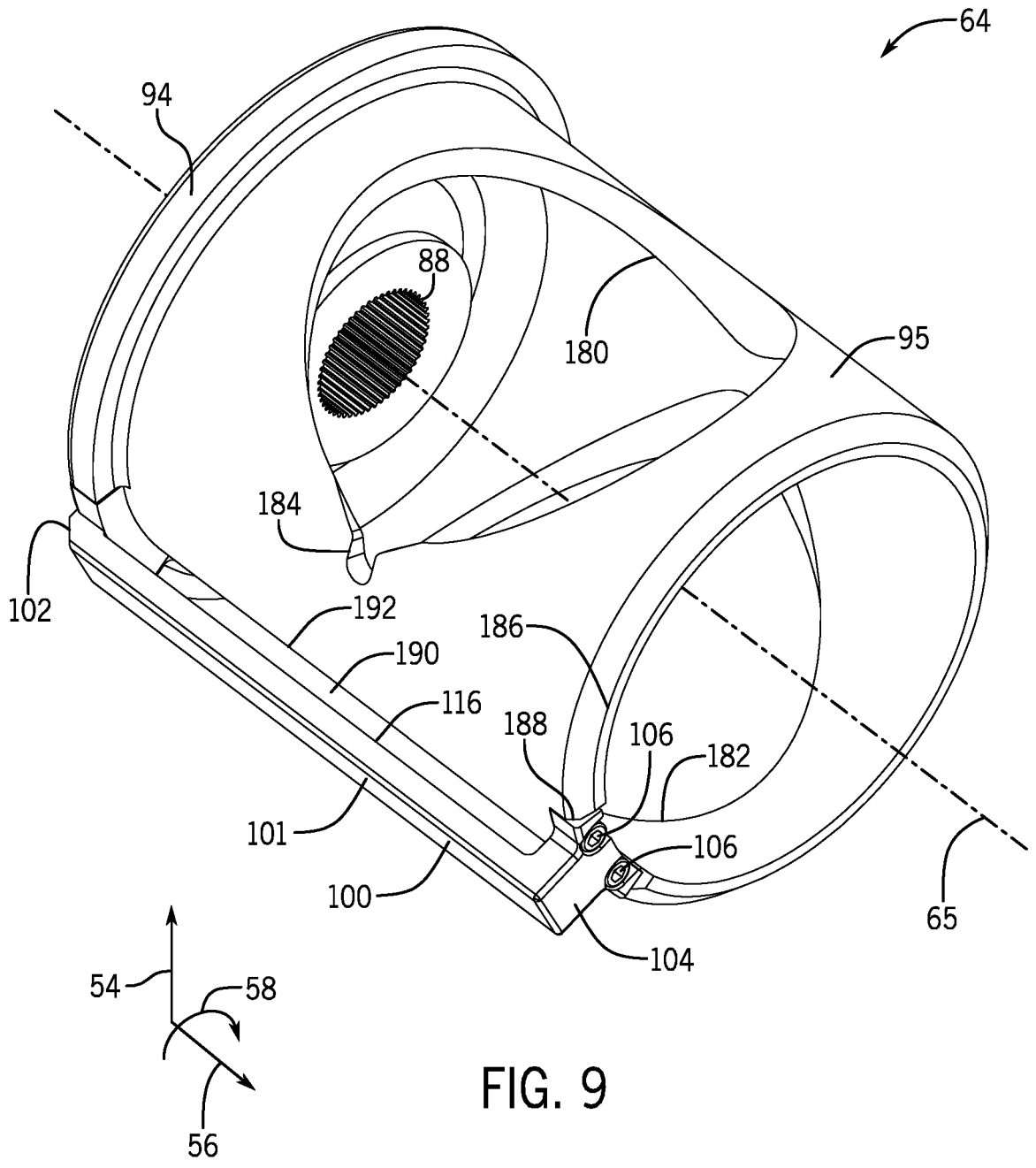
FIG. 9 is a front perspective view of an inner cylinder of the portion of the assembly of FIG. 4, in accordance with an embodiment of the present disclosure.

FIG. 9 is a front perspective view of the inner cylinder 64 and the first bar 100, in accordance with an embodiment of the present disclosure. As discussed above, the inner cylinder 64 may rotate about the central axis 65 via one or more actuators (e.g., actuators 53 shown in FIG. 2). A connecting rod may couple to the opening 88 formed in the end wall 134 to enable the one or more actuators to drive the movement of the inner cylinder 64. As shown, the inner cylinder 64 may also include the wall 95 that includes a first opening 180 and a second opening 182 that is diametrically opposed to the first opening 180. The first opening 180 and the second opening 182 partially define the bore 78 of the assembly 62 (FIG. 3). In the illustrated embodiment, the inner cylinder 64 also includes a conduit groove 184 on an edge of the first opening 180. It should be appreciated that a similar conduit groove may be provided on a respective edge of the second opening 182.

In the illustrated embodiment, the first end portion 102 of the first bar 100 is coupled to the lip portion 94 at one end of the inner cylinder 64 via the one or more fasteners 130 (FIG. 5), and the second end portion 104 of the first bar 100 is coupled to an edge 186 (e.g., annular edge) of the wall 95 at another end of the inner cylinder 64 via the one or more fasteners 106. The second end portion 104 of the first bar 100 may be positioned within a recess 188 formed in the edge 186, such that the second end portion 104 is flush (e.g., substantially flush, does not protrude axially) from the edge 186 of the inner cylinder 64.

While FIG. 9 shows two fasteners 106 that couple the second end portion 104 of the first bar 100 to the inner cylinder 64, it should be appreciated that any suitable number (e.g., 1, 2, 3, 4, or more) of fasteners 106 in any of a variety of locations may be utilized to the couple the second end portion 104 of the first bar 100 to the inner cylinder 64. Similarly, while FIG. 5 shows two fasteners 130 that couple the first end portion 102 of the first bar 100 to the inner cylinder 64, it should be appreciated that any suitable number (e.g., 1, 2, 3, 4, or more) of fasteners 130 in any of a variety of locations may be utilized to the couple the first end portion 102 of the first bar 100 to the inner cylinder 64.

As shown, a gap 190 (e.g., radial gap) is formed between an outer surface 192 of the wall 95 that defines the inner cylinder 64 and the surface 116 of the axially-extending portion 101 of the first bar 100. The gap 190 is configured to receive a portion of the wall 98 of the outer cylinder 66 (FIG. 3). The illustrated configuration of the first bar 100 enables the first bar 100 to be coupled to the inner cylinder 64 at both the first end portion 102 and the second end portion 104 and to drive the rotation of the first ram 68 (FIG. 3), while the outer cylinder 66 surrounds the inner cylinder 64.

The first bar 100 coupled to the inner cylinder 64 at both the first end portion 102 and the second end portion 104 may provide various advantages. For example, the first bar 100 may have increased stability and strength, as compared to a bar or support structure that is coupled to an inner cylinder in other ways (e.g., only at one end or a center portion). Furthermore, the first bar 100 is capable of contacting and exerting a force across the length (e.g., approximately equal to or greater than 75, 80, 85, 90, or 95 percent of an entire axial length) of the first ram 68, thereby providing a reliable seal across the valve 50.

Figure 10:
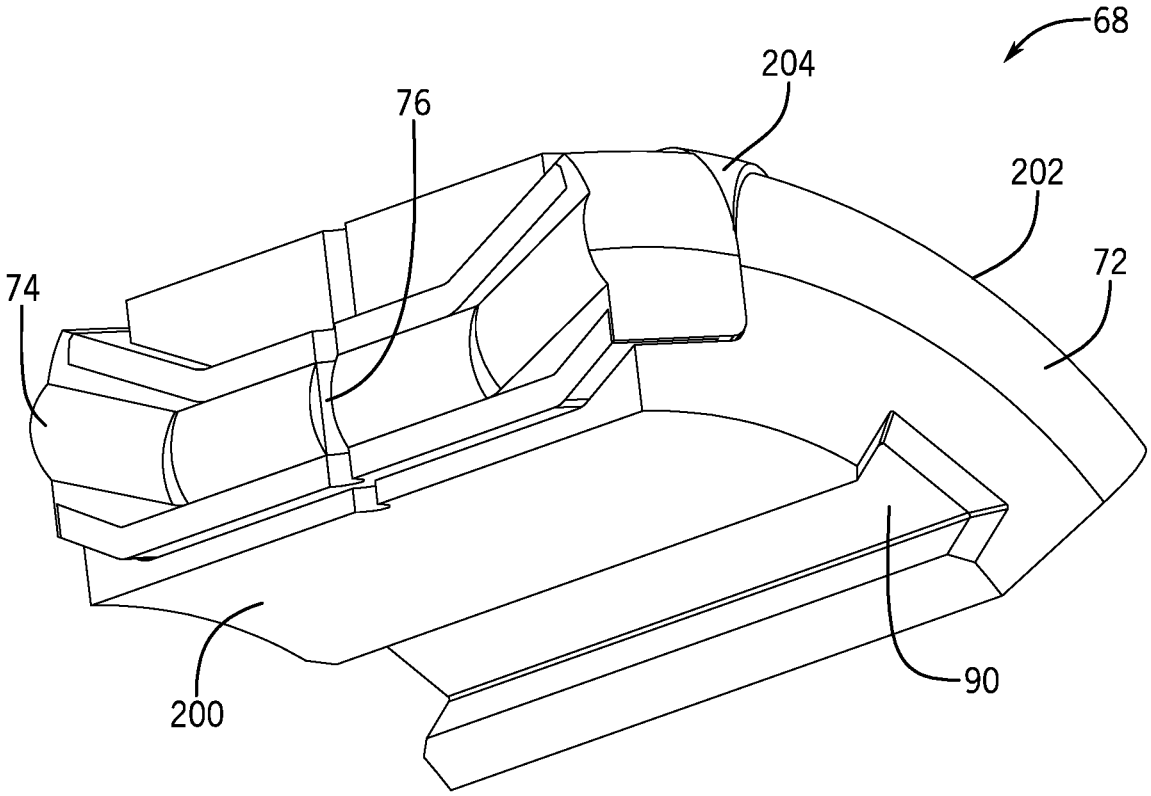
FIG. 10 is a front perspective view of a ram that may be part of the assembly of FIG. 3, in accordance with an embodiment of the present disclosure.

FIG. 10 is a front perspective view of the first ram 68 that may be part of the assembly 62 of FIG. 3, in accordance with an embodiment of the present disclosure. As shown, the first ram 68 includes the ram body 72 and the packer 74. The first ram 68 also includes the recess 76 that is configured to receive the conduit 20 (FIG. 2). The packer 74 is configured to contact and to seal against the packer of the second ram 70 (FIG. 3) when the valve 50 (FIG. 2) is in the closed position.

The first ram 68 includes the recess 90 formed in a first curved surface 200 (e.g., cylinder-contacting surface). In the illustrated embodiment, the recess 90 extends across an entire length of the first ram 68 (e.g., from one side to another side). As discussed above, the recess 90 is configured to receive the first bar 100 that is coupled to the inner cylinder 64 (FIG. 3), and the first curved surface 200 is configured to contact and/or be positioned adjacent to the outer cylinder 66 (FIG. 3). A radius of curvature of the first curved surface 200 may correspond to a radius of curvature of the wall 98 of the outer cylinder 66 to facilitate positioning the first ram 68 adjacent to the outer cylinder 66. The first ram 68 also includes a second curved surface 202 that is configured to contact and/or face an inner surface of the housing 52 (FIG. 2). A radius of curvature of the second curved surface 202 may correspond to a radius of curvature of the inner surface of the housing 52 to facilitate positioning the first ram 68 within the housing 52. As shown, the first ram 68 also includes a top seal 204 that extends across the second curved surface 202 to seal against the inner surface of the housing 52.

It should be appreciated that the second ram 70 (FIG. 3) may have the same configuration. For example, the second ram 70 may include the ram body 72, the packer 74, the recess 76, and the recess 92, as well as respective first and second curved surfaces and a respective top seal.

Figure 11:
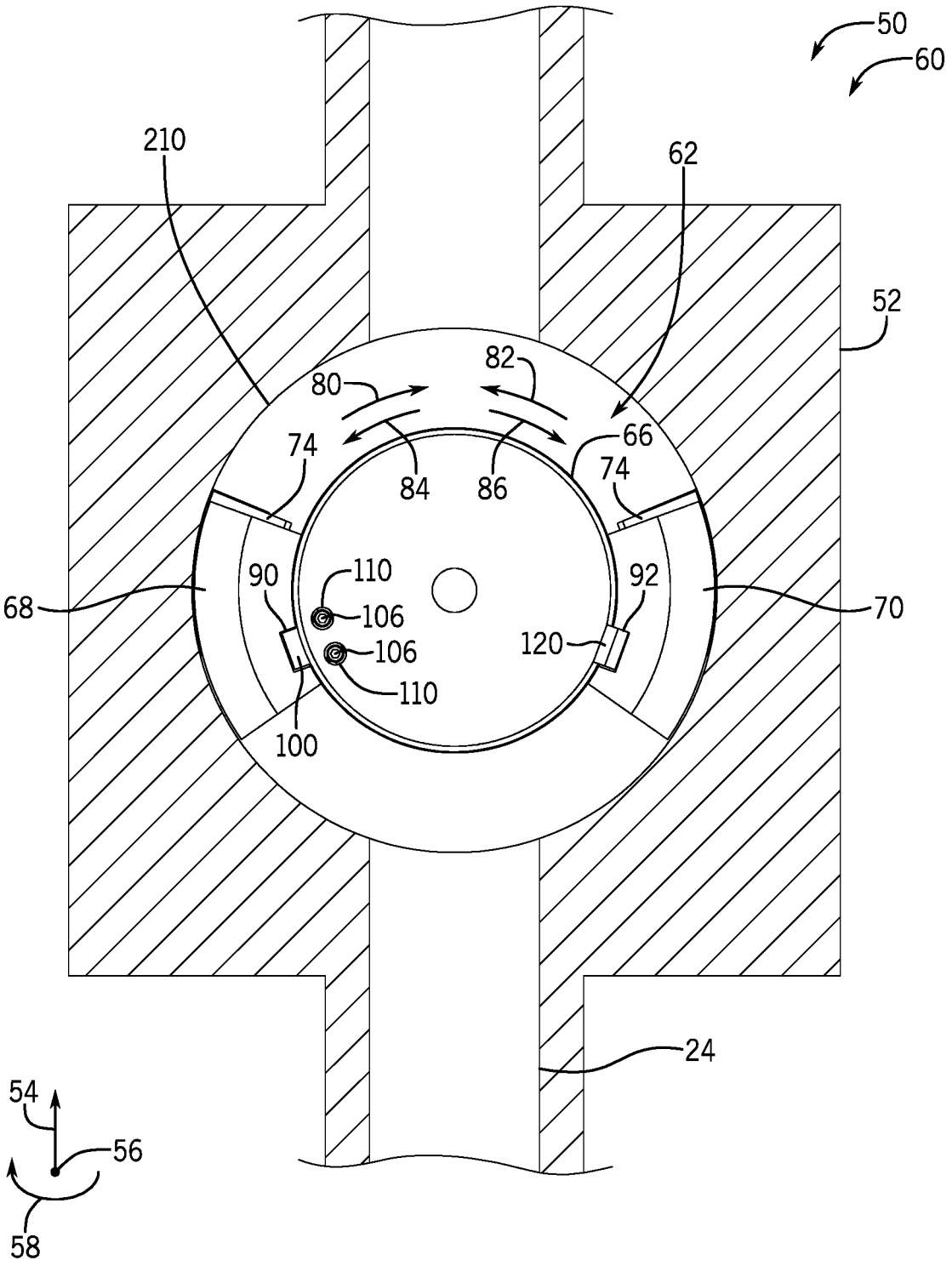
FIG. 11 is an end view of a portion of the valve of FIG. 2 in the open position, in accordance with an embodiment of the present disclosure.
Figure 12:
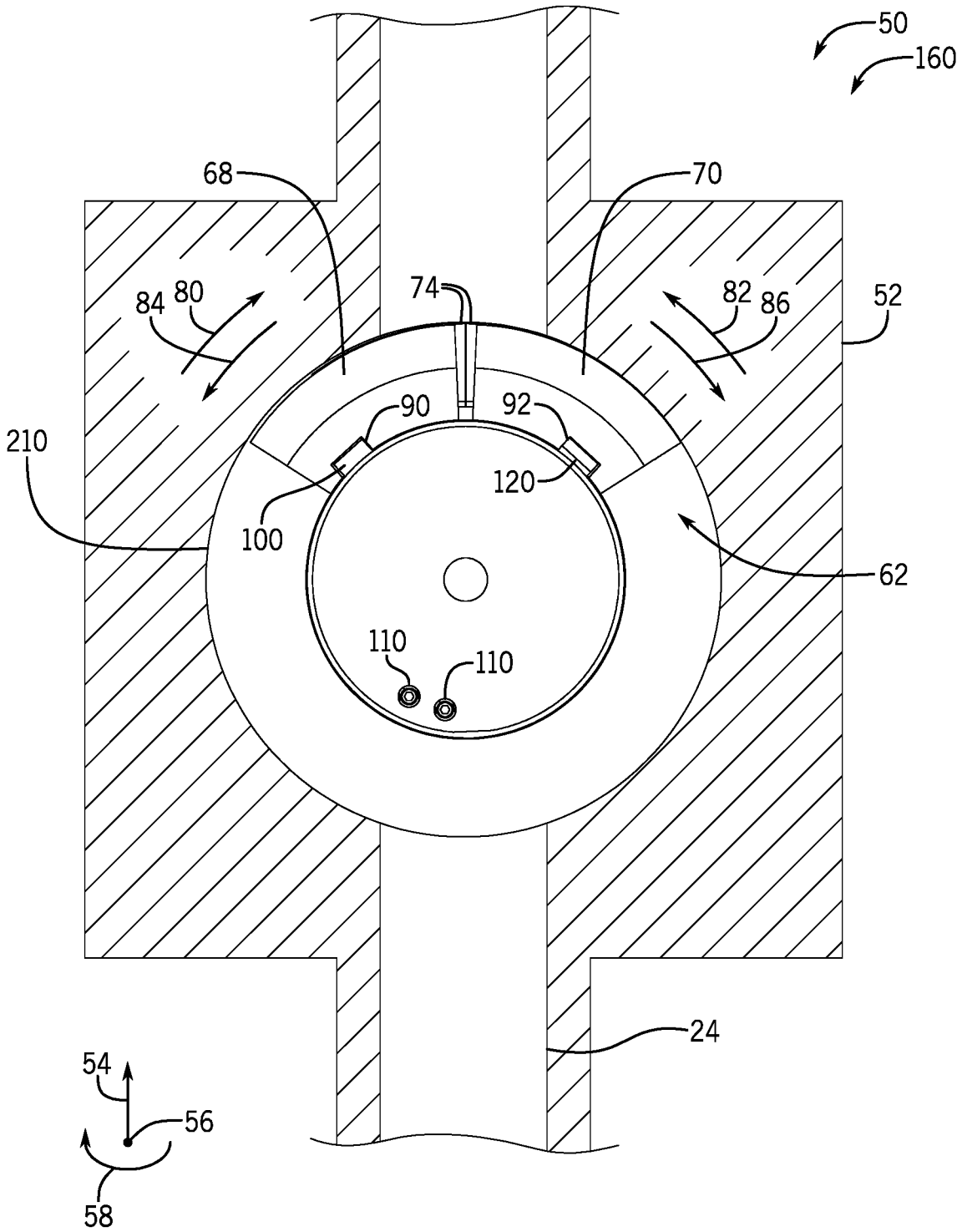
FIG. 12 is an end view of the portion of the valve of FIG. 11 in the closed position, in accordance with an embodiment of the present disclosure.

FIG. 11 is a front end view of a portion of the valve 50 in the open position 60, and FIG. 12 is a front end view of the portion of the valve 50 in the closed position 160, in accordance with an embodiment of the present disclosure. As shown, the assembly 62 is positioned within a cavity 210 (e.g., cylindrical cavity) of the housing 52. The assembly 62 includes the first ram 68 that moves with the inner cylinder 64 (FIG. 3) and the second ram 70 that moves with the outer cylinder 66. The first bar 100 is coupled to the inner cylinder 64 via the one or more fasteners 106 accessible via the openings 110 while the valve 50 is in the open position 60 (e.g., accessible via the opening 110 only while the valve 50 is in the open position 60), and the first bar 100 is positioned within the recess 90 of the first ram 68. The second bar 120 is coupled to the outer cylinder 66, and the second bar 120 is positioned within the recess 92 of the second ram 70.

In the open position 60 shown in FIG. 11, the first ram 68 and the second ram 70 do not seal the bore 24, and thus, the valve 50 enables pressurized fluid to flow across the valve 50 (e.g., via the bore 78 of the assembly 62 shown in FIG. 3). In the closed position 160 shown in FIG. 12, the first ram 68 and the second ram 70 seal the bore 24, and thus, the valve 50 blocks pressurized fluid to flow across the valve 50. In particular, the respective packers 74 of the first ram 68 and the second ram 70 contact and seal against one another to seal the bore 24. The first ram 68 and the second ram 70 may have various other features that are not illustrated in FIGS. 11 and 12. For example, the first ram 68 and the second ram 70 may also include respective top seals (e.g., the top seal 204 shown in FIG. 10) that seal against the inner surface of the cavity 210 of the housing 52.

To move from the open position 60 to the closed position 160, the inner cylinder 64 is driven (e.g., via the one or more actuators 53 shown in FIG. 2) in the direction of arrow 80, and the outer cylinder 66 is driven (e.g., via the one or more actuators 53) in the direction of arrow 82. The first bar 100 moves with the inner cylinder 64, and the first bar 100 engages and drives the first ram 68 to move in the direction of arrow 80. Similarly, the second bar 120 moves with the outer cylinder 66, and the second bar 120 engages and drives the second ram 70 to move in the direction of arrow 82.

To move from the closed position 160 to the open position 60, the inner cylinder 64 is driven (e.g., via the one or more actuators 53) in the direction of arrow 84, and the outer cylinder 66 is driven (e.g., via the one or more actuators 53) in the direction of arrow 86. The first bar 100 moves with the inner cylinder 64, and the first bar 100 engages and drives the first ram 68 to move in the direction of arrow 84. Similarly, the second bar 120 moves with the outer cylinder 66, and the second bar 120 engages and drives the second ram 70 to move in the direction of arrow 86.

The configuration of the components of the assembly 62 may facilitate installation of the assembly 62 within the housing 52. For example, to install the assembly 62 within the housing 52, the first ram 68 and the second ram 70 may be positioned within the housing 52. The first ram 68 and the second ram 70 may be positioned within the housing 52 by opening one wall or side of the housing 52, and pushing or sliding the first ram 68 and the second ram 70 into the cavity 210 of the housing 52. Then, the inner cylinder 64, the outer cylinder 66, the first bar 100, and the second bar 120 (e.g., previously assembled as a unit) may be positioned within the housing 52 by aligning the first bar 100 with the recess 90 of the first ram 68, aligning the second bar 120 with the recess 92 of the second ram 70, and then pushing or sliding the unit into the cavity 210 of the housing 52.

Furthermore, with reference to at least FIGS. 3-5, it should be appreciated that the inner cylinder 64, the outer cylinder 66, the first bar 100, and the second bar 120 may be assembled into the unit by coupling the second bar 120 to the outer cylinder 66, then pushing or sliding the inner cylinder 64 into the outer cylinder 66 (e.g., via an open end of the outer cylinder 66 opposite the end wall 108), and then coupling the first bar 100 to the inner cylinder 64 (e.g., by fastening the first end portion 102 to the lip portion 94, inserting the second end portion 104 through the groove 96 in the wall 98 of the outer cylinder 66, and then fastening the second end portion 104 by accessing the fasteners 106 through the openings 110).

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The invention claimed is:

1. An assembly for a valve, comprising:

an inner cylinder;

an outer cylinder circumferentially surrounding the inner cylinder; and a first bar comprising a first end portion coupled to the inner cylinder and a second end portion coupled to the inner cylinder, wherein the second end portion extends radially outwardly through a groove extending circumferentially about a curved wall of the outer cylinder to enable the inner cylinder and the first bar to rotate relative to the outer cylinder; and a first ram comprising a first recess configured to receive the first bar, wherein the first bar is configured to engage and to drive the first ram to rotate with the inner cylinder and the first bar.

2. The assembly of claim 1, wherein a portion of the curved wall of the outer cylinder is positioned within a gap defined between the inner cylinder and an axially-extending portion of the first bar.

3. The assembly of claim 1, wherein the first bar extends across at least 90 percent of a length of the first ram.

4. The assembly of claim 1, comprising a second bar coupled to the outer cylinder.

5. The assembly of claim 4, comprising a second ram comprising a second recess configured to receive the second bar, wherein the second bar is configured to engage and to drive the second ram to rotate with the outer cylinder and the second bar.

6. The assembly of claim 1, wherein the inner cylinder and the outer cylinder each comprise openings that are aligned with one another to define a bore that enables a fluid flow across the assembly while in an open position.

7. The assembly of claim 1, wherein the first end portion of the first bar is coupled to a respective edge of an end wall of the inner cylinder, and the second end portion of the first bar is coupled to a respective edge of a respective curved wall of the inner cylinder.

8. The assembly of claim 1, wherein the second end portion of the first bar is coupled to an edge of a respective curved wall of the inner cylinder via one or more fasteners that are accessible via one or more openings formed in an end wall of the outer cylinder.

9. An assembly for a valve, comprising:

an inner cylinder;

an outer cylinder circumferentially surrounding the inner cylinder;

a first bar comprising a first end portion coupled to the inner cylinder and a second end portion coupled to the inner cylinder; and a first ram comprising a first recess, wherein the first bar is configured to engage the first recess of the first ram to enable rotation of the inner cylinder and the first bar to drive rotation of the first ram.

10. The assembly of claim 9, comprising:

a second bar coupled to the outer cylinder; and a second ram comprising a second recess configured to receive the second bar, wherein the second bar is configured to engage the second recess of the second ram to enable rotation of the outer cylinder and the second bar to drive rotation of the second ram.

11. The assembly of claim 9, wherein the second end portion extends radially outwardly from the inner cylinder through a groove extending circumferentially about a curved wall of the outer cylinder to enable the inner cylinder and the first bar to rotate relative to the outer cylinder.

12. The assembly of claim 9, wherein a portion of a curved wall of the outer cylinder is positioned within a gap defined between the inner cylinder and an axially-extending portion of the first bar.

13. The assembly of claim 9, wherein the first bar extends across at least 90 percent of a length of the first ram.

14. A valve for a mineral extraction system, comprising:

a housing;

an assembly positioned within the housing, the assembly comprising:

an inner cylinder;

an outer cylinder circumferentially surrounding the inner cylinder;

a first bar comprising a first end portion that is coupled to a first end of the inner cylinder and a second end portion that is coupled to a second end of the inner cylinder; and a first ram comprising a first recess, wherein the first bar is configured to engage the first recess of the first ram to enable rotation of the inner cylinder and the first bar to drive rotation of the first ram to adjust the valve between an open position and a closed position.

15. The valve of claim 14, comprising:

a second bar coupled to the outer cylinder; and a second ram comprising a second recess configured to receive the second bar, wherein the second bar is configured to engage the second recess of the second ram to enable rotation of the outer cylinder and the second bar to drive rotation of the second ram to adjust the valve between the open position and the closed position.

16. The valve of claim 15, wherein the first ram comprises a first body and a first packer, the second ram comprises a second body and a second packer, and the first packer and the second packer contact and seal against one another to seal a bore of the valve when the valve is in the closed position.

17. The valve of claim 14, wherein the second end portion of the first bar extends radially outwardly from the inner cylinder through a groove extending circumferentially about a curved wall of the outer cylinder to enable the inner cylinder and the first bar to rotate relative to the outer cylinder.

18. The valve of claim 14, wherein a portion of a curved wall of the outer cylinder is positioned within a gap defined between the inner cylinder and an axially-extending portion of the first bar.

19. The valve of claim 14, comprising one or more actuators configured to drive the rotation of the inner cylinder and the first bar.

20. An assembly for a valve, comprising:

an inner cylinder;

an outer cylinder circumferentially surrounding the inner cylinder; and a first bar comprising a first end portion coupled to the inner cylinder and a second end portion coupled to the inner cylinder, wherein the second end portion extends radially outwardly through a groove extending circumferentially about a curved wall of the outer cylinder to enable the inner cylinder and the first bar to rotate relative to the outer cylinder;

wherein the second end portion of the first bar is coupled to an edge of a respective curved wall of the inner cylinder via one or more fasteners that are accessible via one or more openings formed in an end wall of the outer cylinder.

* * * * *